US008991664B2

(12) United States Patent
Hwang

(10) Patent No.: US 8,991,664 B2
(45) Date of Patent: Mar. 31, 2015

(54) TRANSFORMING A SLEEVED GARMENT INTO A SELF-FASTENED WEDGE

(71) Applicant: Peter G. H. Hwang, Santa Rosa, CA (US)

(72) Inventor: Peter G. H. Hwang, Santa Rosa, CA (US)

( * ) Notice: Subject to any disclaimer, the term of this patent is extended or adjusted under 35 U.S.C. 154(b) by 45 days.

(21) Appl. No.: 13/861,185

(22) Filed: Apr. 11, 2013

(65) Prior Publication Data

US 2014/0305973 A1 Oct. 16, 2014

(51) Int. Cl.

| | |
|---|---|
| ***A41H 33/00*** | (2006.01) |
| ***D06F 89/02*** | (2006.01) |
| *A41H 43/02* | (2006.01) |

(52) U.S. Cl.

CPC ..... *D06F 89/026* (2013.01)
USPC ..... 223/37

(58) Field of Classification Search

USPC ..... 223/37, 38; 2/116, 125, 126, 269
See application file for complete search history.

(56) References Cited

U.S. PATENT DOCUMENTS

| | | | | |
|---|---|---|---|---|
| 1,873,954 | A * | 8/1932 | Cooper | 223/37 |
| 2,710,968 | A * | 6/1955 | Page | 2/105 |
| 4,777,994 | A * | 10/1988 | Nederveld | 160/84.04 |
| 5,011,052 | A * | 4/1991 | Craig | 223/37 |
| 5,056,657 | A * | 10/1991 | Frye | 206/494 |
| 5,333,765 | A * | 8/1994 | Takizawa | 223/28 |
| 6,250,115 | B1 * | 6/2001 | Suzuki | 66/171 |

* cited by examiner

*Primary Examiner* — Ismael Izaguirre
(74) *Attorney, Agent, or Firm* — Patentry

(57) ABSTRACT

A garment stored, transported, and displayed as a soft wedge. A triangular prism is transformed from flat fabric pieces by flexible fasteners and a method of folding. Sleeves and other delicate decorations and components are protected from damage by folding into a self enclosed polyhedron defined by two triangles and three trapezoid faces without pins, straps, ribbons, cans, cylinders, bags, boxes, or bands.

15 Claims, 7 Drawing Sheets

TRANSFORMING A SLEEVED GARMENT INTO A SELF-FASTENED WEDGE

CROSS REFERENCE TO RELATED PATENT APPLICATIONS

Figure 1:
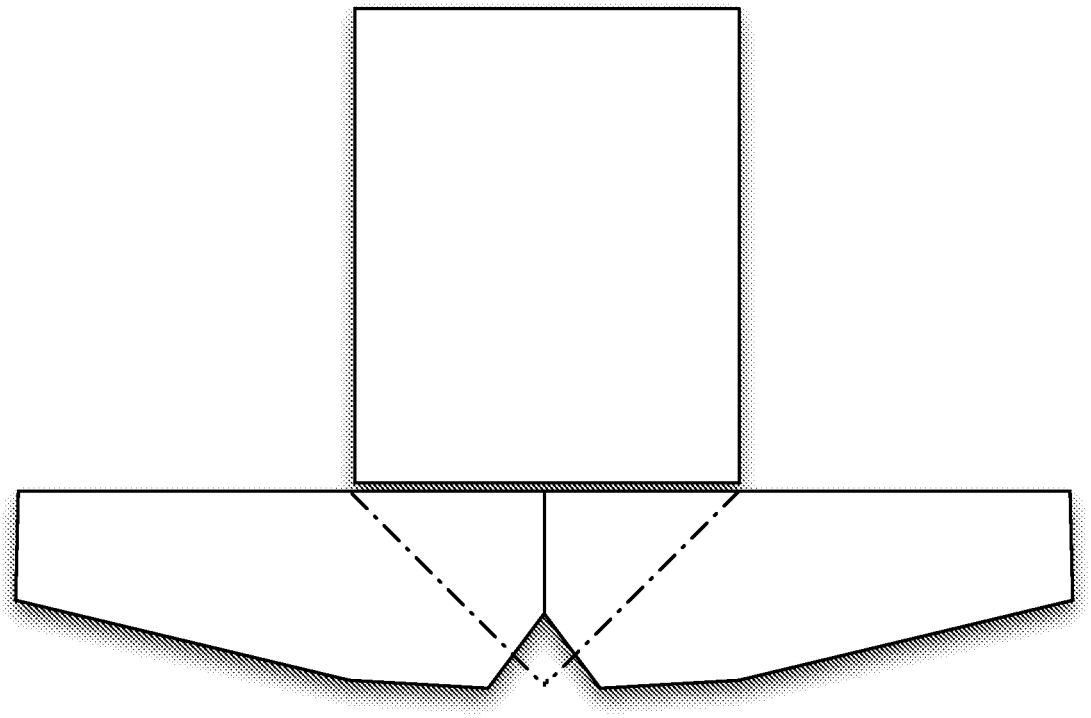

None.

BACKGROUND

Conventional folding of garments is oriented to display in retail sales. A substantial portion of retail sales clerk time is devoted to refolding clothes after inspection by a potential customer. Clothing folded for retail display can only be stored or transported in bags, boxes, or other containers or require pins and clips to retain the display configuration.

Well known retailers train their new employees in procedures for example: How to Fold a T-shirt the Gap Way "1 Lay the t-shirt flat with the front of the t-shirt facing up. The side of the t-shirt should be facing you, meaning that the shirt's collar should be to your right and the bottom of the t-shirt should be to your left.

2 Put your left index finger in the middle of the t-shirt and "draw" a line toward you until you get about 1½ inches from the side of the shirt. Pinch both sides of the fabric at this point with your left hand.

3 Keeping the first pinch secure, use your right hand to draw another imaginary line from the first pinch up the t-shirt to the seam on the shoulder. Pinch the front and back fabric here with your right hand. Now both hands are pinching the t-shirt.

4 Bring your right hand down past your left hand to the bottom of the t-shirt directly under your left hand. Your arms will be crossed. (Again, imagine a line going from your left—pinched—hand to the bottom of the t-shirt.) Pinch this fabric with the right hand so that your are now pinching four layers of t-shirt with that hand: the front and back of the shoulder seam and the front and back of the bottom.

5 Make sure the t-shirt looks like a mess of fabric at this point. That means you're doing it the right way.

6 Holding firmly to all pinches, lift the t-shirt from the flat surface while uncrossing your arms.

7 Shake the t-shirt until it hangs from your hands smoothly. It should no longer look like a mess of fabric.

8 Lower the t-shirt back onto the flat surface sleeve-first so that the front of the sleeve that's hanging touches the surface, creating a horizontal fold symmetrical to the one created by your pinches.

9 Now, lay the t-shirt down towards you (with the front facing up), and you're done."

Other methods of folding/rolling shirts apply only to sleeveless or short-sleeve shirts. In some methods the shirts are folded with the collar face down and the short sleeves folded back underneath the bottom half of the shirt. Other methods of folding T-shirts involve crossing your arms to grasp both the hem of the shirt and the top of the T near the collar. None of these methods retain their shape unless left undisturbed. In some methods the shirts are folded in two parallel folds and then rolled from collar to near the hem. In some cases the hem is first folded into a cuff which is used to enclose the rolled shirt. This tubular result is more suitable for storage and packing but makes identification of which shirt is which more difficult as all distinguishing characteristics are hidden by the hem. Furthermore rolling sleeves does not result in a thin tubular object. It becomes more like a fabric dumbbell. Thus it can be appreciated that what is needed is a method to distinguish a folded long sleeved garment from other folded shirts and enable the folded long sleeve garment to be easily packed, transported, and stored without necessary refolding after translation or disturbance.

SUMMARY OF THE INVENTION

The invention is a method of folding a garment which consists of a front and rear panel and two sleeves attached to the panels at a collar, and at an armpit. The garment is folded on the centerline of the panels along a bilateral axis of symmetry. The sleeves may be folded and aligned with the center line to protect fasteners or decorative attachments on the front or rear panel. A diagonal fold establishes a triangular core on which the remainder of the garment is wound. The collar and adjacent fabric is tucked into a pocket created adjacent to the armpits by the diagonal folding.

BRIEF DESCRIPTION OF DIAGRAMS

FIGS. 1-8 illustrate the unfolded and progressively folded garment.

DETAILED DISCLOSURE OF EMBODIMENTS

The method of the invention may be practiced on a flat surface such as a counter or a tabletop. The method of the invention may be practiced entirely in mid-air by raising or lowering hands or other maniples suitable for grasping. A garment is variously described as having a plurality of sleeves coupled to at least one panel. The method is most easily understood by referring to seams on the sleeves and the panels but the practice of the invention does not depend on having actual seams once the principle of the method is understood. Within this application we use the invented term sleeveseam to mean a longitudinal locus of points between the hole for the arm and the hole for the hand. It evokes the inseam of pants which is between the legs. The sleeveseam is meant to suggest the side of the sleeve closest to the torso ie. between the armpit and the palm of the hand at rest. Similarly we define the term sideseam to mean the longitudinal area on the garment on the torso or bodice or trunk between the armpit and the hip which is closest to the wearer's arms at rest. The sideseam is analogous to the term outseam on pants. Knit fabrics may not actually have a seam there but our definition applies to the longitudinal area where those practiced in the wearing of conventional clothing would expect to find it.

For ease of understanding, one illustrative embodiment provides for sleeves which are constructed with a sleeveseam from the armpit to the hand hole or annulus at the end of the sleeve most distant from the collar hole or annulus. Likewise, an illustrative embodiment assumes that a sideseam couples a front panel to a back panel of the garment from an armpit to a hem or waist hole or waist annulus of the garment.

It can easily be understood that the principles of the invention apply equally to tubular sleeves which have no sleeveseam connecting an armpit to a hand annulus. One familiar with garments with sleeves would know where a conventional sleeveseam would be and can practice the invention without further explanation. Similarly, a knit garment can be constructed in one panel without one or more sideseams but upon laying such a garment flat on a surface such as a table, those familiar with garments would easily distinguish the front of a garment from the rear of a garment and would be able to practice the invention as if a sideseam were present at the juncture of the front of a garment and the rear of a garment.

By aligning each sleeve with an adjacent sideseam and with the centerline of the bilateral axis of symmetry, the first and second diagonal folds are performed from armpit to collar. After aligning the armpits together and the sideseams at the hem of the waist opening or annulus of the panels, the first orthogonal fold is performed. The fold along the centerline of the axis of bilateral symmetry is orthogonal to an imaginary line which could be drawn from armpit to armpit. Buttons, bows, snaps, zippers, and other fasteners typically coupled to the garment adjacent to the centerline would either be protected or exposed by the orthogonal fold. By wristpoint we mean either the end of the sleeve if the sleeve is not long enough to extend beyond the lower bound of the garment or the point on the sleeve which touches the lower bound of the garment for a sleeve which extends below the lower bound of the garment. It is the lowest point at which you can grasp both the sideseam and the sleeveseam without slack in one or the other.

Assigning the approximate distance measurement from armpit to armpit as 2 A, the approximate distance measurement of an armpit to the nearest point on the centerline is A. The next fold is positioned at a distance 2 A from the armpit and is orthogonal to the centerline. In embodiments this second orthogonal fold can be performed before or after the fold on the centerline. Note the first and second orthogonal folds are mutually orthogonal and may be performed in either order.

On the condition that the waist hem of the garment is substantially 2 A from the armpits, the second orthogonal fold may be skipped entirely. Its purpose is solely to square the garment for the following series of alternating diagonal and orthogonal folds. In an embodiment, the third diagonal fold brings a point along the centerline to a point on the seams. In one embodiment this point is distance A from the armpit. It forms a triangular core around which the remaining steps are performed. A series of alternating orthogonal and diagonal folds are performed winding the garment around the triangular core. In an other embodiment, when a hem is an odd number of distance A from the armpit, the first diagonal fold will move the seam corner to the centerline. A next to last fold maintains an acute apex of the triangle at the armpit. The final fold consists of tucking the collar and adjacent fabric into a pocket formed where the seams would be in a garment with one or more seams.

One beneficial effect of the invention is to distinguish folded garments with long sleeves from rolled t-shirts with short sleeves. Another beneficial effect is to protect fasteners or decorative attachment on the centerline from being damaged or snagging other garments in storage or transportation. Another beneficial effect is to enable identification and selection of the garment from other similarly folded garments by exposure of the breast logo or rear panel yoke embroidery on the external surface of the folded garment. Another beneficial effect is to allow the folded garment to be tossed, thrown, or held in one hand without resultant inadvertent unfolding. An other beneficial effect is to enable flexibility of garment storage either vertically like books in a bookcase or horizontally like towels and bedding. Another beneficial effect is that while consumers may own garments of widely varying length they are less likely to have garments with diverse armpit to armpit dimensions so the folded garments are more likely to store in similar dimensioned triangles.

In an exemplary embodiment, this invention is a method for transforming a garment into a wrapped package comprising: placing a long sleeved garment on a flat surface with the collar opening toward you and the waist opening away from you and the sleeves spread to left and right; folding each sleeve diagonally from armpit to collar so that the edge of the sleeve is on top of the edge where the front panel is fastened to the back panel; noticing the width of the panels from armpit to armpit; grasping both sleeve and edge of lower panel and folding across the centerline to marry with the other sleeve and with the other edge of lower panel; folding the sleeve ends and the waist edge of the panel up at the point where the length to the armpit is approximately equal to the width of the panels from armpit to armpit; folding the corner at the centerline of the panels diagonally across to marry the two edges; folding the resulting triangular portion up so the lowest point is at the armpit; folding diagonally again from armpit to centerline so that you have a large triangle with a pocket toward the collar; and tucking the collar and adjacent material into the pocket formed between the edges of the front and rear panel.

Among various embodiments, this invention includes a method for transforming a garment having 4 annuluses, two sleeves, and a bilaterally symmetrical front panel coupled to bilaterally symmetrical rear panel into a substantially self-enclosed polyhedron that has two congruent parallel triangular bases, a triangular prism, for compact storage and transport, the method comprising: grasping and suspending said garment with a first maniple at a first armpit, wherein the armpit is a location on said garment where a sleeve is coupled to both the bilaterally symmetrical front and rear panels at a maximal distance from a collar annulus; grasping and elongating a first sleeve with a second maniple at a first wristpoint, wherein the wristpoint is a point on a sleeveseam; raising the first maniple and lowering the second maniple to further grasp a first sideseam at a point equidistant from the first armpit as the first wristpoint, wherein the sideseam is a locus of points at which the bilaterally symmetrical front and rear panels are coupled; raising the second maniple to be horizontally aligned with the first maniple which achieves a first diagonal fold between the first armpit and the collar annulus; grasping with the second maniple a second wristpoint on a sleeveseam of a second sleeve; grasping with the second maniple a second sideseam at a point equidistant from the second armpit as the second wristpoint, which achieves a second diagonal fold between the second armpit and the collar annulus; and grasping with the first maniple, the second armpit and horizontally elongating said garment between the two maniples which achieves a first orthogonal fold along an axis of bilateral symmetry on a centerline of both front and rear panels, wherein horizontally is substantially equidistant from a center of gravitational force.

Among various embodiments, this invention further includes among other steps: releasing the first and second armpits grasped by the first maniple; grasping with the first maniple both sideseams and sleeveseams at a point from the armpits equal to a width of the panels measured from the first armpit to the second armpit; releasing everything grasped by the second maniple; grasping with the second maniple the first orthogonal fold along an axis of bilateral symmetry on a centerline of both front and rear panels at a point which determines a second orthogonal fold which is substantially orthogonal to the first orthogonal fold; folding a waist of the garment and both wristends of the first and second sleeves toward the collar annulus; rotating the second maniple with respect to the first maniple; grasping in the second maniple the sideseams and sleevesearms at a point substantially halfway between the armpits and the first maniple, which achieves a third diagonal fold between the centerline and the sideseams; grasping in the first maniple the armpits, which achieves a third orthogonal fold which is substantially parallel to the second orthogonal fold; grasping in the second maniple along the axis of bilateral symmetry on a centerline of both front and rear panels, which achieves a fourth diagonal fold between the armpits and the centerline of both front and rear panels; releasing everything grasped in the first maniple; and tucking a portion of the front and rear panels immediately adjacent to the collar annulus into a triangular cavity formed among the seams by the third orthogonal fold and the fourth diagonal fold, whereby said garment is transformed into a triangular prism suitable for transportation in one hand and storage without additional pins, straps, bands, or enclosures to remain folded. It is understood that a maniple may be actuated by hydraulic, electrical, magnetic, or neuromuscular control signals and power. In an embodiment the maniple is controlled by a processor configured by a non-transitory store in which is encoded computer executable instructions.

Among various embodiments, the folding of the sleeves and panels encloses fasteners on the front or rear panels within the prism to avoid snagging or abrasion of the fasteners, wherein fasteners comprises buttons, zippers, and ties.

Among various embodiments, the folding of the sleeves and panels exposes decorative appliques on the front or rear panels on the exterior of the prism to enable identification of the sponsorship, ownership, or affiliation of the garment, go niners.

Among various embodiments, the wristpoint on the sleeveseam is determined by the shortest length of material from the armpit among the following components: the sleeve, the front panel, and the rear panel, when any one of the three is substantially shorter than the other components.

Among various embodiments, the wristpoint on the sideseam is determined by the shortest length of material from the armpit among the following components: the sleeve, the front panel, and the rear panel, when any one of the three is substantially shorter than the other components.

Among various embodiments, this invention includes a method for transformation of a sleeved garment into a portable wedge comprising: tucking a collar of a garment and adjacent fabric area into a triangular prism of folded sleeves and at least one panel.

In various embodiments, a plurality of panels comprise a front panel coupled to a rear panel at sideseams between an armpit and a hip.

In various embodiments, a sleeve comprises a tube extending from an armpit to a hand annulus and wherein the garment comprises two sleeves coupled to the panels at the armpits.

In various embodiments, a tube is a flexible fabric fastened to itself by a sleeveseam along two non-contiguous edges of the fabric.

Among various embodiments, this invention further includes among other steps: forming a triangular prism of folded sleeves and at least one panel by: folding the at least one panel on a centerline across the axis of bilateral symmetry to enclose the sleeves within the left and right sides of the at least one panel, diagonally folding a corner of fabric on a centerline to overlay an edge of the at least one panel whereby a quadrilateral is formed with two acute angles and two obtuse angles.

In various embodiments, this invention further includes among other steps: folding a corner of fabric at an acute angle orthogonal to the centerline to form a quadrilateral of fabric with one obtuse angle and one acute angle; and folding another corner of fabric at a diagonal to the centerline to form a triangular prism of folded sleeves and at least one panel.

In various embodiments, the sleeves are enclosed within the left and right sides of the at least one panel by diagonally folding a sleeve to align with the edge of a panel attached at an armpit of the sleeve.

In various embodiments, folding the at least one panel on a centerline across the axis of bilateral symmetry encloses fasteners, decorative components, or fragile materials within the triangular prism to prevent loss or damage.

In various embodiments, folding the at least one panel on a centerline across the axis of bilateral symmetry exposes embroidery, inks, colors, names, numbers, badges, logos, words, and trademarks on the visible exterior of the triangular prism to enable identification, affiliation, or promotion.

Referring now to the FIGS. 1-8, a top view is shown of a garment having two sleeves and at least one panel. In FIG. 1 the dashed lines illustrate the folds which enables the sleeveseams to lie on top of the sideseams to which they are connected at their respective armpits.

Figure 2A:
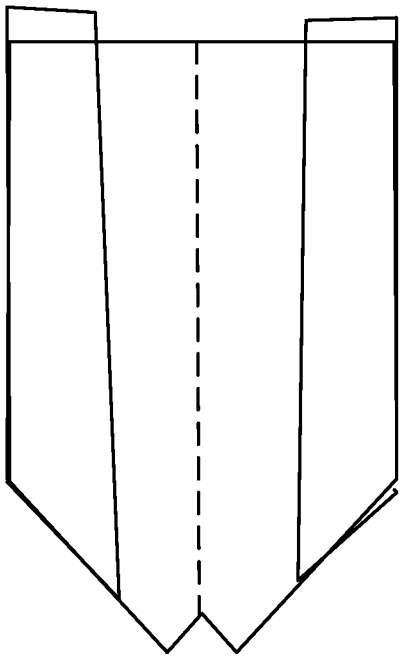
Figure 2B:
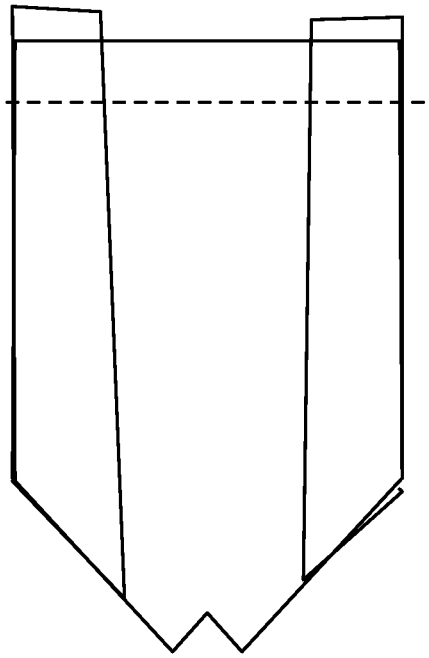

In FIGS. 2*a* and 2*b* the result of folding the arms is illustrated but two possible next folds are illustrated by the dashed lines. In FIG. 2*a* a fold is shown by a dashed line on the centerline of the bilateral axis of symmetry. In FIG. 2*b*, the fold is orthogonal to the centerline and serves to square the hem and ends of the sleeve at a point approximately at a distance of 2 A from the armpits on the sideseam where the distance measured from armpit to armpit is also 2 A.

Figure 3A:
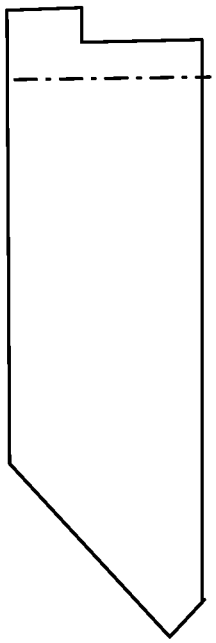
Figure 3B:
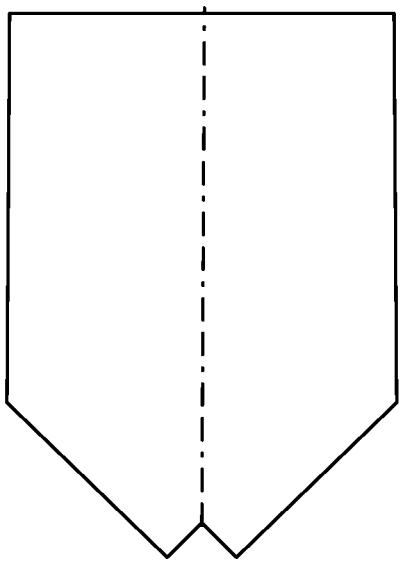

Referring now to FIGS. 3*a* and 3*b* there are the two possible results from the folds of FIGS. 2*a* and 2*b* respectively. The next proposed fold for FIG. 3*a* is to square the sleeves and hem of the garment. The next proposed fold for FIG. 3*b* is on the centerline of the bilateral axis of symmetry. The result of either fold is the same.

Figure 4:
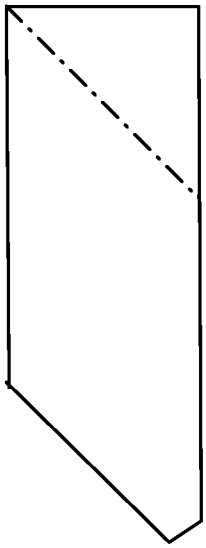

In FIG. 4 the result of either 3*a* or 3*b* is illustrated. The edge of the folded panel is approximately a distance of 2 A from the armpit. The next diagonal fold in this embodiment brings the corner on the centerline to the sideseam at a point approximately 1 A distance from the armpits.

Figure 5:
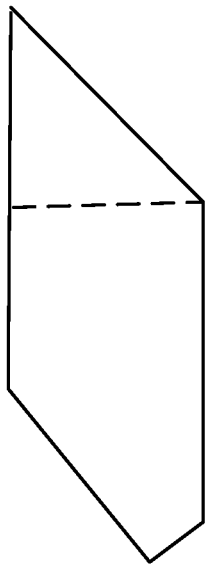

In FIG. 5, there is an acute angle of the panel approximately 2 A from the armpits. The orthogonal fold which is orthogonal to the centerline will bring the acute angle to the armpit.

Figure 6:
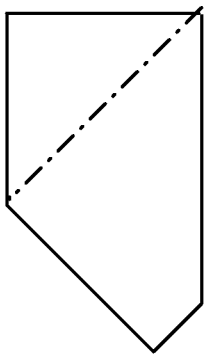

In FIG. 6 is illustrated the result of the orthogonal fold which results in a figure with two substantially right angles and by the dashed line is shown the final diagonal fold. Note that seams adjacent to the armpit will form two sides of a pocket upon completing the folding.

Figure 7:
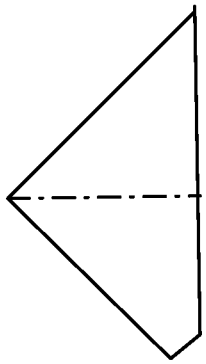

FIG. 7 shows a relatively thin portion of the garment adjacent to the collar and the thicker triangle of folded fabric with perfect corners. The final fold is illustrated with a dashed orthogonal line.

Figure 8:
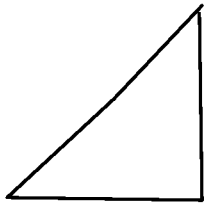

However, the final method step further includes tucking the collar and its adjacent fabric into the pocket formed in the thicker triangle between the armpit and the centerline by the series of alternating orthogonal and diagonal folding steps. FIG. 8 shows one triangular side of the wedge which can be easily handled without falling apart.

CONCLUSION

The present invention provides improved storage, transportation, and display of sleeved garments as a soft wedge. A triangular prism is transformed from flat fabric pieces by flexible fasteners and a method of folding. Sleeves and other delicate decorations and components are protected from damage by folding into a self enclosed polyhedron defined by two triangles and three trapezoid faces without pins, straps, ribbons, cans, cylinders, bags, boxes, or bands. The invention can be easily distinguished from placing clothes on a hanger or in a container. The invention can be easily distinguished from stuffing clothes into a bag sewn into the garment as a pocket. The invention can be easily distinguished from folding, rolling, or coiling a substantially flat substantially rectangular piece of fabric. The invention can be easily distinguished from conventional folded garments by picking up the transformed object in one hand and putting it down. In contrast conventionally folded objects can remain in their configuration if they are not disturbed, and once moved, must be refolded. Other methods of rolling simple shirts anonymize them into tubes with little or no distinguishing identification.

The invention claimed is:

1. A method for transforming a garment into a wrapped package comprises:

placing a long sleeved garment on a flat surface with the collar opening toward you and the waist opening away from you and the sleeves spread to left and right;

folding each sleeve diagonally from armpit to collar so that the edge of the sleeve is on top of the edge where the front panel is fastened to the back panel;

noticing the width of the panels from armpit to armpit;

grasping both sleeve and edge of lower panel and folding across the centerline to marry with other sleeve and edge of lower panel;

folding the sleeve ends and the waist edge of the panel up at the point where the length to the armpit is approximately equal to the width of the panels from armpit to armpit;

folding the corner at the centerline of the panels diagonally across to meet the edges;

folding the resulting triangular portion up so the lowest point is at the armpit;

folding diagonally again from armpit to centerline so that you have a large triangle with a pocket toward the collar; and tucking the collar and adjacent material into the pocket formed between the edges of the front and rear panel.

2. A method for transforming a garment having 4 annuluses, two sleeves, and a bilaterally symmetrical front panel coupled to bilaterally symmetrical rear panel into a substantially self-enclosed polyhedron that has two congruent parallel triangular bases, a triangular prism, for compact storage and transport, the method comprising:

grasping and suspending said garment with a first maniple at a first armpit, wherein the armpit is a location on said garment where a sleeve is coupled to both the bilaterally symmetrical front and rear panels at a maximal distance from a collar annulus;

grasping and elongating a first sleeve with a second maniple at a first wristpoint, wherein the wristpoint is a point on a sleeveseam;

raising the first maniple and lowering the second maniple to further grasp a first sideseam at a point equidistant from the first armpit as the first wristpoint, wherein the sideseam is a locus of points at which the bilaterally symmetrical front and rear panels are coupled;

raising the second maniple to be horizontally aligned with the first maniple which achieves a first diagonal fold between the first armpit and the collar annulus;

grasping with the second maniple a second wristpoint on a sleeveseam of a second sleeve;

grasping with the second maniple a second sideseam at a point equidistant from the second armpit as the second wristpoint, which achieves a second diagonal fold between the second armpit and the collar annulus; and grasping with the first maniple, the second armpit and horizontally elongating said garment between the two maniples which achieves a first orthogonal fold along an axis of bilateral symmetry on a centerline of both front and rear panels, wherein horizontally is substantially equidistant from a center of gravitational force.

3. The method of claim 2 further comprising:

releasing the first and second armpits grasped by the first maniple;

grasping with the first maniple both sideseams and sleeveseams at a point from the armpits equal to a width of the panels measured from the first armpit to the second armpit;

releasing everything grasped by the second maniple;

grasping with the second maniple the first orthogonal fold along an axis of bilateral symmetry on a centerline of both front and rear panels at a point which determines a second orthogonal fold which is substantially orthogonal to the first orthogonal fold;

folding a waist of the garment and both wristends of the first and second sleeves toward the collar annulus;

rotating the second maniple with respect to the first maniple;

grasping in the second maniple the sideseams and sleeveseams at a point substantially halfway between the armpits and the, which achieves a third diagonal fold between the first maniple centerline and the sideseams;

grasping in the first maniple the armpits, which achieves a third orthogonal fold which is substantially parallel to the second orthogonal fold;

grasping in the second maniple along the axis of bilateral symmetry on a centerline of both front and rear panels, which achieves a fourth diagonal fold between the armpits and the centerline of both front and rear panels;

releasing everything grasped in the first maniple; and tucking a portion of the front and rear panels immediately adjacent to the collar annulus into a triangular cavity formed among the seams by the third orthogonal fold and the fourth diagonal fold, whereby said garment is transformed into a triangular prism suitable for transportation in one hand and storage without additional pins, straps, bands, or enclosures to remain folded.

4. The method of claim 2 wherein the folding of the sleeves and panels encloses fasteners on the front or rear panels within the prism to avoid snagging or abrasion of the fasteners, wherein fasteners comprises buttons, zippers, and ties.

5. The method of claim 2 wherein the folding of the sleeves and panels exposes decorative appliques on the front or rear panels on the exterior of the prism to enable identification of the sponsorship, ownership, or affiliation of the garment.

6. The method of claim 2 wherein the wristpoint on the sleeveseam is determined by the shortest length of material from the armpit among the following components: the sleeve, the front panel, and the rear panel, when any one of the three is substantially shorter than the other components.

7. The method of claim 2 wherein the wristpoint on the sideseam is determined by the shortest length of material from the armpit among the following components: the sleeve, the front panel, and the rear panel, when any one of the three is substantially shorter than the other components.

8. A method for transformation of a sleeved garment into a portable wedge comprising:

tucking a collar of a garment and adjacent fabric area into a triangular prism of folded sleeves and a front panel coupled to a rear panel at sideseams between an armpit and a hip.

9. The method of claim 8 wherein a sleeve comprise a tube extending from an armpit to a hand annulus and wherein the garment comprises two sleeves coupled to the panels at the armpits.

10. The method of claim 9 wherein a tube is a flexible fabric fastened to itself by a sleeveseam along two non-contiguous edges of the fabric.

11. A method for transformation of a sleeved garment by:

folding at least one panel on a centerline across the axis of bilateral symmetry to enclose the sleeves within the left and right sides of the at least one panel, and diagonally folding a corner of fabric on a centerline to overlay an edge of the at least one panel whereby a quadrilateral is formed with two acute angles and two obtuse angles.

12. The method of claim 11 further comprising:

folding a corner of fabric at an acute angle orthogonal to the centerline to form a quadrilateral of fabric with one obtuse angle and one acute angle;

folding another corner of fabric at a diagonal to the centerline to form a triangular prism of folded sleeves and at least one panel, and tucking a collar of a garment and adjacent fabric area into the triangular prism of folded sleeves and at least one panel.

13. The method of claim 11 wherein the sleeves are enclosed within the left and right sides of the at least one panel by diagonally folding a sleeve to align with the edge of a panel attached at an armpit of the sleeve.

14. The method of claim 11 wherein folding the at least one panel on a centerline across the axis of bilateral symmetry encloses at least one of the group of fasteners, decorative components, and fragile materials within the triangular prism to prevent loss or damage.

15. The method of claim 11 wherein folding the at least one panel on a centerline across the axis of bilateral symmetry exposes one of the group of embroidery, inks, colors, names, numbers, badges, logos, words, and trademarks on the visible exterior of the triangular prism to enable identification, affiliation, or promotion.

* * * * *